US005902509A

United States Patent [19]

Brückner et al.

[11] Patent Number: 5,902,509

[45] Date of Patent: May 11, 1999

[54] METHOD AND APPARATUS FOR INDUCTIVELY HEATING A REFRACTORY SHAPED MEMBER

[75] Inventors: Raimund Brückner, Niedernhausen, Germany; Rüdiger Grau, Graz, Austria; Daniel Grimm, Bad Schwalbach, Germany; Steve Lee, Cardross, United Kingdom

[73] Assignee: Dider-Werke AG, Wiesbaden, Germany

[21] Appl. No.: 08/687,025

[22] Filed: Jul. 25, 1996

[30] Foreign Application Priority Data

Jul. 25, 1995 [DE] Germany ..... 195 26 967
Jul. 25, 1995 [DE] Germany ..... 195 26 970

[51] Int. Cl.[6] ..... H05B 6/38

[52] U.S. Cl. ..... 219/644; 219/635; 219/676; 219/672; 373/155; 373/160

[58] Field of Search ..... 219/644, 635, 219/643, 674, 676, 672, 656, 662; 373/152, 153, 155, 160

[56] References Cited

U.S. PATENT DOCUMENTS

| | | | |
|---|---|---|---|
| 1,607,264 | 11/1926 | Ledwinka et al. . | |
| 2,227,866 | 1/1941 | Somes . | |
| 2,806,117 | 9/1957 | Koontz et al. . | |
| 4,258,241 | 3/1981 | Soworowski | 219/656 |
| 4,409,451 | 10/1983 | Taylor | 219/674 |
| 4,418,258 | 11/1983 | McNealy et al. | 219/644 |
| 4,532,396 | 7/1985 | Burack et al. | 219/644 |
| 4,574,172 | 3/1986 | Burack et al. | 219/644 |
| 4,590,347 | 5/1986 | Thatcher et al. | 219/644 |
| 5,052,597 | 10/1991 | Brückner . | |
| 5,190,716 | 3/1993 | Brückner et al. . | |
| 5,397,876 | 3/1995 | Shimamoto et al. | 219/644 |
| 5,523,546 | 6/1996 | Lake | 219/644 |

FOREIGN PATENT DOCUMENTS 38 42 690 6/1990 Germany .

*Primary Examiner*—Philip H. Leung
*Attorney, Agent, or Firm*—Wenderoth, Lind & Ponack, L.L.P.

[57] ABSTRACT

A method and an apparatus for inductively heating a refractory shaped member provided with an internal space, particularly for a metallurgical vessel, enable as rapid, uniform heating of the shaped member as possible. An inner inductor is introduced into the internal space, the shaped member is heated from the interior by such inductor, and the inductor then is removed from the internal space.

138 Claims, 3 Drawing Sheets

METHOD AND APPARATUS FOR INDUCTIVELY HEATING A REFRACTORY SHAPED MEMBER

BACKGROUND OF THE INVENTION

The invention relates to a method and apparatus of inductively heating a refractory shaped member which has an internal space, e.g. a tubular internal space or a space forming a passage.

Such shaped members are in particular part of a melt discharge device or a melt dispensing device of a metallurgical vessel. They are preheated in order to prevent undesired cooling down of the melt flowing through them, particularly freezing thereof.

A refractory discharge for a continuous casting installation is disclosed in DE 38 42 690 A1, corresponding to U.S. Pat. No. 5,052,597. The discharge passage is surrounded from the exterior by an induction coil with which the outer wall within it may be inductively heated in a controlled manner. The coil is a component of the discharge unit. Such arrangement therefore is complex and expensive, which is of particular significance because such refractory shaped discharge members are wear members that must be replaced.

Refractory shaped discharge members, particularly immersed discharge members, are commonly heated by means of gas burners. This has the disadvantage that carbon, which is a material component of the shaped member, can burn out. It is also unfavorable that a non-uniform temperature distribution in the shaped member can occur during the heating process. Temperature differentials of, for instance, about 400 K have been observed. Furthermore, the heating process requires a considerable period of time.

SUMMARY OF THE INVENTION

It is the object of the invention to provide a method and apparatus to achieve as rapid and uniform heating of the refractory shaped member as possible.

In accordance with the invention, the above object is achieved by provision of a method and apparatus of the above type, but wherein an inner inductor is introduced into the internal space of the refractory shaped member, the member is heated by the inner inductor, and thereafter the inner inductor is removed from the internal space.

Thereby it is possible to achieve a rapid and uniform heating of the refractory member or component that may be, for instance, a submerged discharge or a tube of a "Tube-in-Tube" outlet system with which the outflow of the melt is to be interruptible and/or controllable, or a supply and dosing system for a belt or twin roll caster with which the melt discharge is to be interruptible and/or controllable.

An increased availability of the installation is achieved by the invention because freezing problems are prevented. The method and the apparatus are suitable not only for heating at the commencement of pouring but also for heating when pouring is interrupted in order to maintain the refractory member at a suitable temperature.

The inner inductor may be one or more cooled induction coils, e.g. a helical induction coil.

Advantageous embodiments of the invention will be apparent from the dependent claims and the following description of exemplary embodiments and features.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
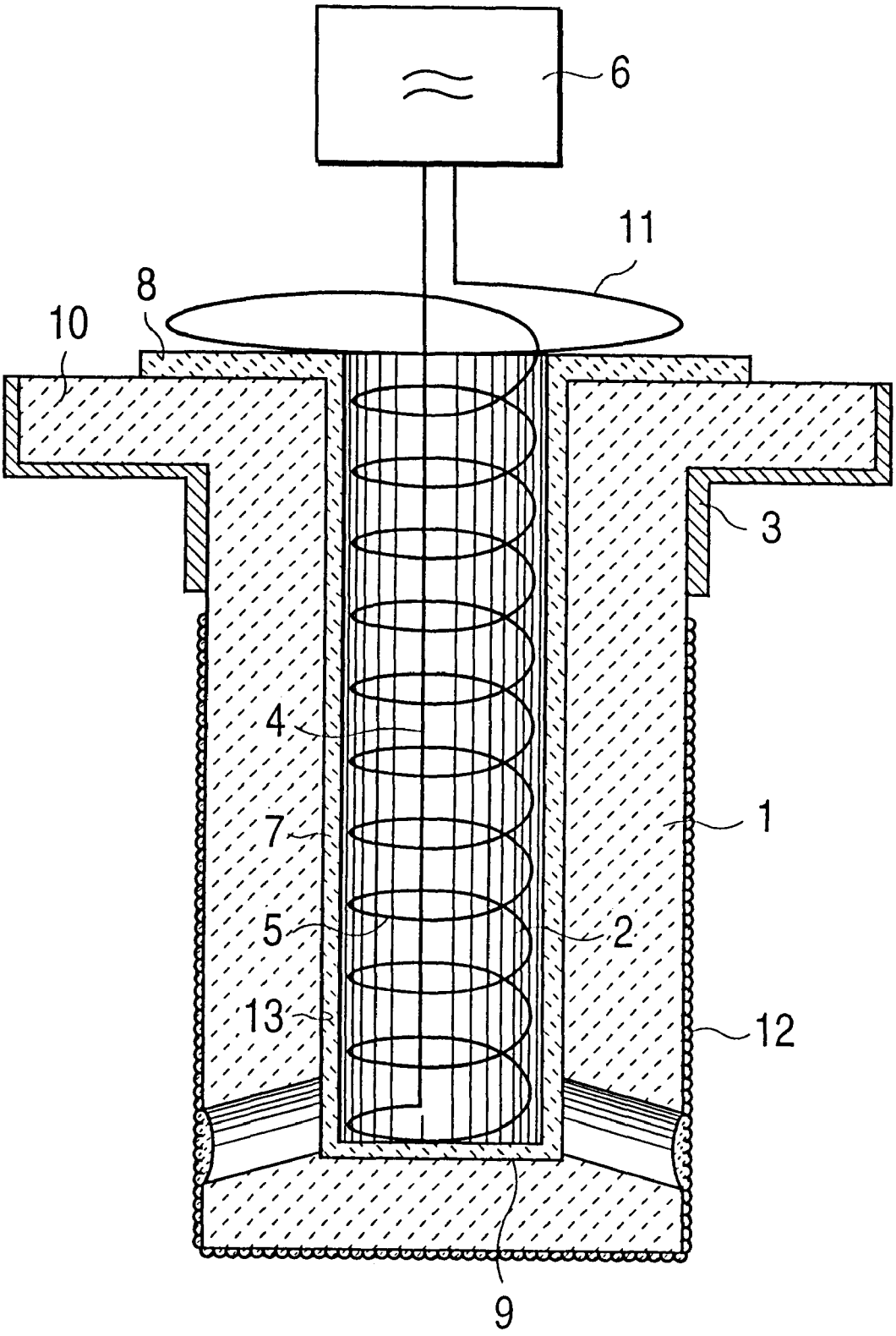
FIG. 1 is a schematic cross section illustrating the present invention applicable to the heating of a submersible discharge nozzle intended for use with a metallurgical vessel.

FIG. 1 shows a submersible discharge member (immersed pouring tube) of a shape known per se. Such member is a refractory shaped member 1 formed of a ceramic, carbon-containing material which may be inductively coupled to an electrical alternating field, resulting in heating of member 1. The member 1 has a tubular, cylindrical internal space 2. Member 1 is provided in a region of an exterior thereof with a metallic outer shell 3. The metallic outer shell 3 thus shields the member 1 from electromagnetic fields, so that member 1 would not be uniformly heatable with an external induction coil.

In the state illustrated in FIG. 1, i.e. when member 1 is to be heated, an inner inductor 4 is slid into the tubular, cylindrical internal space 2. The inner inductor 4 has a cooled, helical induction coil 5 which is connected to a generator 6. The dimensions, and particularly the length of the induction coil 5 are so matched to the internal space 2 that coil 5 extends over the entire length of the internal space 2 to the greatest extent possible. Furthermore, the diameter of coil 5 is matched to the diameter of the internal space 2. The induction coil 5 and generator 6 may be such elements as would be understood by one of ordinary skill in the art. Such elements particularly may be as disclosed in U.S. Pat. No. 5,052,597, the disclosure of which is incorporated herein by reference. Other inductor and generator structures, as would be understood by one of ordinary skill in the art, may be used in carrying out the present invention. For example, the inductor may be cooled in the manner disclosed in German Applications P 195 31 555.3 and P 196 03 317.9. Thus, the inductor coil may be cooled by compressed air or a compressed gas, or by a liquid gas. Also, the coil can be cooled by water. The cooling medium employed may be introduced at one or both ends of the coil or midway between such ends. Also, the inductor 4 may be formed of plural coils, each of which is internally cooled by a separate cooling supply.

The surface of member 1 defining internal space 2 is electrically and/or thermally insulated with respect to the induction coil 5 by a layer 13, for instance a ceramic glaze, so that the member does not come into contact with components conducting electric current and/or no localized overheating occurs.

In accordance with a further embodiment of the invention, the external surface of the induction coil 5 is electrically and/or thermally insulated with respect to the surfaces defining the internal space 2 by means of a tube-shaped member 7.

It is also advantageous to match the induction coil 5 to different geometries or wall thicknesses such that there are different spacings between the induction coil 5 and the surfaces of the regions of member 1 to be heated. Different energy densities thereby are produced in the shaped member. This improves the uniformity of the heating in the event of differing wall thicknesses. The tube-shaped member 7 should be correspondingly constructed.

The tube-shaped member 7 also serves to center the induction coil 5 in the internal space 2. The tube-shaped member 7 is pushed in a friction-locking manner onto the induction coil 5 so that it may be replaced, if necessary. The external diameter of the member 7 is so matched to the internal diameter of the internal space 2 that it may be easily slid with the induction coil 5 into the internal space 2 and also may be withdrawn from the internal space 2. The construction can, however, also be such that the member 7 is first slid into the internal space 2 and the induction coil 5 then slid into the member 7. The member 7 has a flange 8 to limit movement of member 7 inwardly of member 1. Member 7 is closed at the bottom thereof by a floor 9 in the exemplary embodiment.

In order to heat a broadened top region or flange 10 of member 1, the induction coil 5 is provided above the flange 8 with an enlarged or additional winding 11.

The tube-shaped member 7 comprises a highly heat-resistant, ceramic fiber or foam material. It is not necessary that a single member 7 extend over the entire length of the induction coil 5. Two or more tube-shaped members also can be provided and distributed along the length of the induction coil 5. The member 7 or the plural members need not be withdrawable out of the internal space 2. It is also possible to construct the member 7 or the plural members as a lining of the internal space 2, which lining then is decomposed by the melt during the first use of member 1. In order to prevent the member 1 from radiating, i.e. losing, heat to the exterior during the heating process, it can be provided with an external insulation 12, preferably of ceramic fiber material or ceramic foam. This improves the rapid and uniform heating of the member 1.

When member 1 is to be heated, the inner inductor 4 is slid with its tube-shaped member 7 into the internal space 2 and the generator 6 is switched on. The member 1 thus is inductively heated rapidly and uniformly substantially over its entire length. Member 7 is not inductively heated. After reaching the desired temperature, the inner inductor 4 is retracted or withdrawn from the space 2. Member 1 thereby is preheated and ready for a melt pouring operation. The inner inductor 4 may be used for many heating operations, for many submerged discharge operations or on many members 1. Possibilities of use of inductor 4 therefore are independent of the wear of the member 1. The tube-shaped member 7 may be withdrawn from the induction coil 5 when member 7 becomes worn and can be replaced by a new tube-shaped member. In the event of different internal diameters of different members 1, tube-shaped members 7 with correspondingly different external diameters may be kept in readiness. It is thus possible always to slide the induction coil 5 in a centered manner, even with different diameters of the internal spaces 2 of different members 1.

Figure 2:
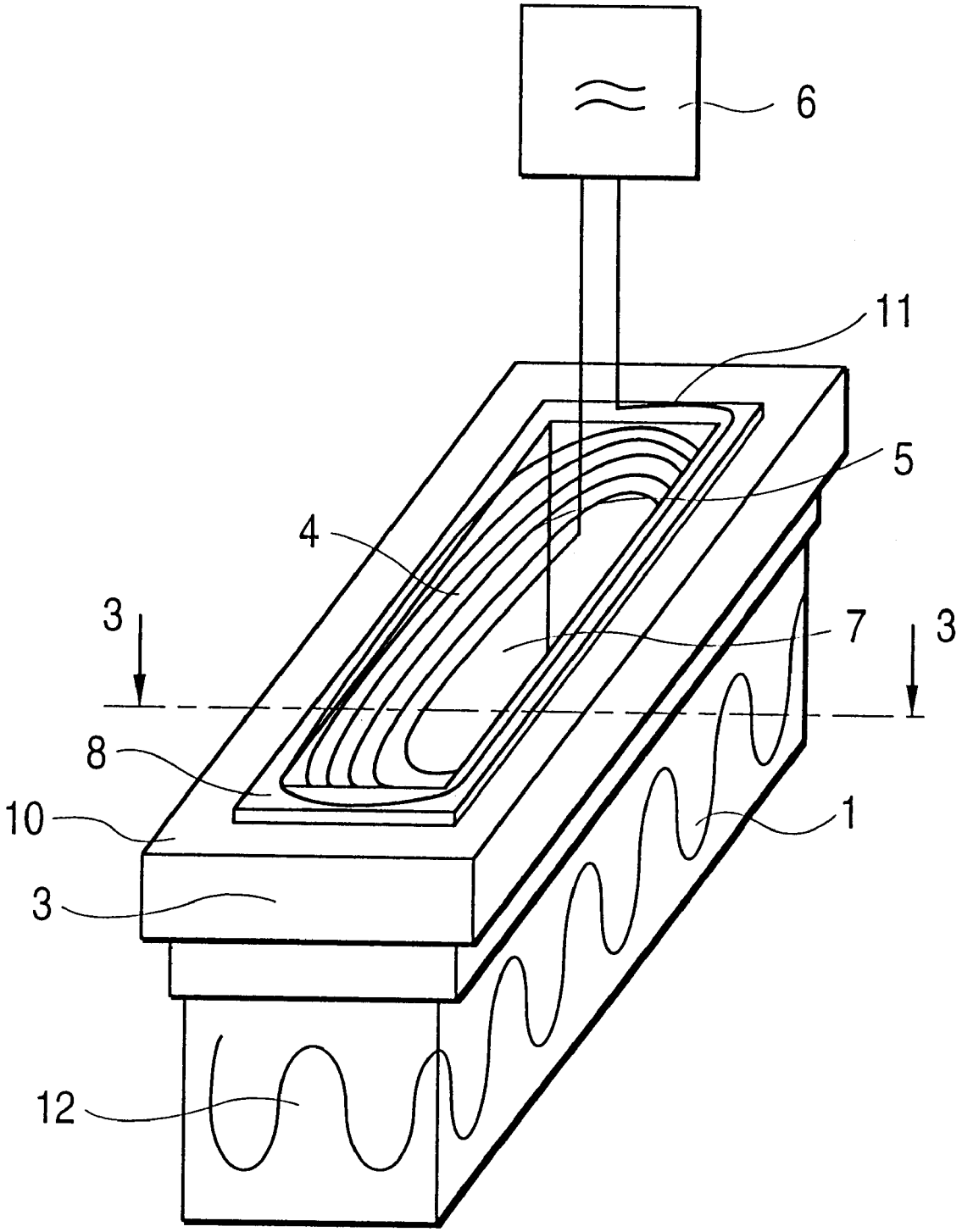
FIG. 2 is a schematic perspective view illustrating another embodiment of the application of the present invention to a discharge nozzle or member having therethrough a rectangular passage and to be employed with a metallurgical vessel.
Figure 3:
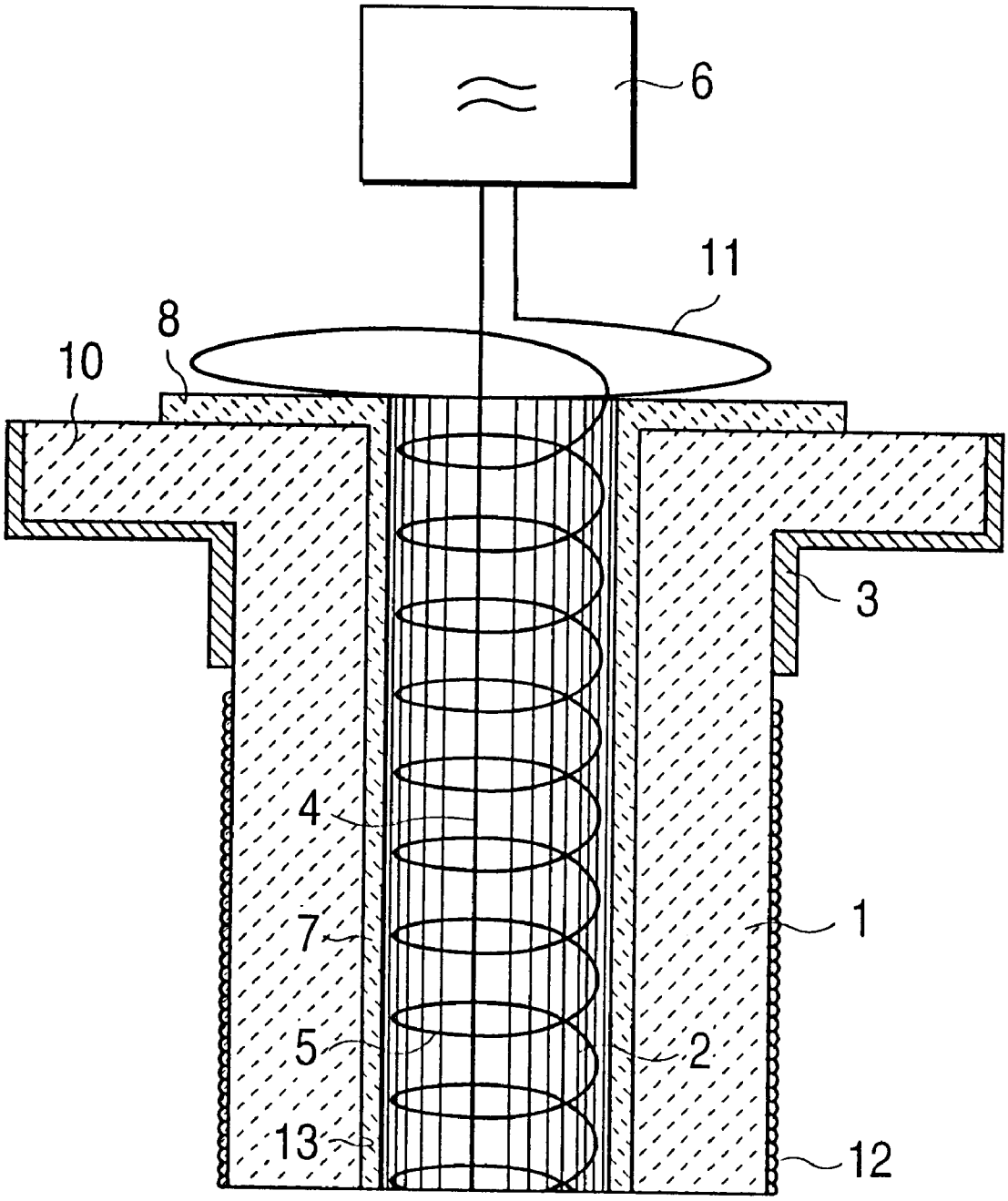
FIG. 3 is a view similar to FIG. 1, but on a cross section along lines 3—3 in FIG. 2.

FIGS. 2 and 3 illustrate another embodiment of the present invention. In this embodiment, the refractory shaped member 1 has therethrough a continuous passage 2 that is elongated laterally and that is rectangular as viewed in plan, i.e. from above in FIG. 2. Such shaped refractory member in and of itself is known. Inner inductor 4 may be at least one cooled induction coil 5 or a plurality of such coils 5 connected to generator 6. The dimensions, particularly the length, and shape of inner inductor 4 are matched to the dimensions and shape of internal space 2 to extend throughout the entire length of space 2 to the greatest extent possible. The wall of member 1 defining space 2 may have thereon an electrically and/or thermally insulated layer 13, for example a ceramic glaze, so that member 1 does not come into contact with components conducting electric current and/or no localized overheating occurs. This embodiment also provides for electrical and/or thermal insulation between inner inductor 4 and the surfaces of member 1 defining space 2 by means of shaped insulation member 7. This embodiment also provides that inner inductor 4 can be matched to different geometries or wall thicknesses of member 1 such that there are different spacing between inner inductor 4 and surfaces of the regions of member 1 to be heated. Differing energy densities thus are produced in member 1, thus improving the uniformity of heating in the event of differing wall thicknesses. Insulation member 7 is correspondingly constructed. Insulation member 7 also centers inner inductor 4 in space 2. Thus, member 7 may be pushed in a friction-locking manner onto coil or coils 5 so that member 7 can be replaced if necessary. The external geometry of member 7 is matched to space 2 so that member 7 easily can slide with the inner inductor therein into space 2 and may be withdrawn from space 2. The construction can be however that member 7 first is slid into space 2, and then inner inductor 4 is slid into member 7. Member 7 has a flange 8 to limit the extent of sliding of member 7 into space 2. In this embodiment, member 7 has an open bottom. In order to heat the passage 2 at the region of the broadened top 10 of member 1, inductor 4 is provided above flange 8 with an additional winding 11. Member 7 may be formed of a highly heat-resistant, ceramic fiber material or ceramic foam material. A single member 7 need not extend throughout the entire length of inductor 4, but rather two or more spaced insulating members can be provided. Insulating member or members 7 need not be removable from space 2. Rather, member 7 can be constructed as a lining of internal space 2. In order to prevent member 1 from radiating, i.e. losing, heat to the exterior during a heating operation, member 1 can be provided with external insulation 12, preferably of ceramic fiber material or ceramic foam material. This feature improves rapid and uniform heating of member 1.

The various alternative manners of use of this embodiment of the present invention to achieve heating of member 1 are analogous to those discussed above regarding the embodiment of FIG. 1.

Although the present invention has been described and illustrated with respect to preferred embodiments thereof, it will be understood by those skilled in the art that various changes and modifications may be made to the specifically described and illustrated embodiments without departing from the scope of the present invention.

We claim:

1. An apparatus for inductively heating a refractory member that is to be employed as part of a melt discharge device and that has therein an internal space through which is to pass the melt to be discharged, said apparatus comprising:

an inner inductor to be introduced selectively into the internal space, to achieve inductive heating of the refractory member from internally thereof, and to be withdrawn from the internal space after heating; and an insulating member in the form of a hollow member having an external configuration to fit in the internal space and an internal configuration to receive and center therein said inner inductor, said insulating member being of a construction to be decomposed when coming into contact with the melt to be discharged.

2. An apparatus as claimed in claim 1, wherein said inner inductor comprises at least one induction coil.

3. An apparatus as claimed in claim 2, further comprising an induction generator connected to said at least one induction coil.

4. An apparatus as claimed in claim 2, wherein said at least one induction coil has a helical shape.

5. An apparatus as claimed in claim 2, wherein said insulating member has a closed inner end.

6. An apparatus as claimed in claim 2, wherein said insulating member has an open inner end.

7. An apparatus as claimed in claim 2, wherein said at least one induction coil is slidable into said insulating member.

8. An apparatus as claimed in claim 2, wherein said insulating member has a configuration to be positioned in the internal space as at least a partial lining of the refractory member.

9. An apparatus as claimed in claim 2, wherein said insulating member includes an outwardly extending flange to abut an end of the refractory member.

10. An apparatus as claimed in claim 2, wherein said insulating member is formed of an electrically and/or thermally insulating material.

11. An apparatus as claimed in claim 2, wherein said at least one induction coil includes an outwardly extending winding to heat an outwardly extending end flange of the refractory member.

12. An apparatus for inductively heating a refractory member having therein an internal space, said apparatus comprising:

an inner inductor to be introduced selectively into the internal space, to achieve inductive heating of the refractory member from internally thereof, and to be withdrawn from the internal space after heating; and an insulating member for aligning said inner inductor centrally within the internal space, said insulating member including an outwardly extending flange to abut an end of the refractory member.

13. An apparatus as claimed in claim 12, wherein said inner inductor comprises at least one induction coil.

14. An apparatus as claimed in claim 13, further comprising an induction generator connected to said at least one induction coil.

15. An apparatus as claimed in claim 13, wherein said at least one induction coil has a helical shape.

16. An apparatus as claimed in claim 13, wherein said insulating member has a closed inner end.

17. An apparatus as claimed in claim 13, wherein said insulating member has an open inner end.

18. An apparatus as claimed in claim 13, wherein said at least one induction coil is slidable into said insulating member.

19. An apparatus as claimed in claim 13, wherein said insulating member comprises a replaceable member.

20. An apparatus as claimed in claim 13, wherein said insulating member has a configuration to be positioned in the internal space as at least a partial lining of the refractory member.

21. An apparatus as claimed in claim 13, wherein said at least one induction coil and said insulating member are separable from each other after an inductive heating operation.

22. An apparatus as claimed in claim 13, wherein said insulating member is formed of an electrically and/or thermally insulating material.

23. An apparatus as claimed in claim 13, wherein said insulating member is formed of a highly heat resistant ceramic fiber material or ceramic foam material.

24. An apparatus as claimed in claim 13, wherein said at least one induction coil includes an outwardly extending winding to heat an outwardly extending end flange of the refractory member.

25. An apparatus for inductively heating a refractory member having therein an internal space, said apparatus comprising:

an inner inductor to be introduced selectively into the internal space, to achieve inductive heating of the refractory member from internally thereof, and to be withdrawn from the internal space after heating; and said inner inductor comprising at least one induction coil including an outwardly extending winding to heat an outwardly extending end flange of the refractory member.

26. An apparatus as claimed in claim 25, further comprising an induction generator connected to said at least one induction coil.

27. An apparatus as claimed in claim 25, wherein said at least one induction coil has a shape and dimensions to correspond to the shape and dimensions of the internal space.

28. An apparatus as claimed in claim 25, wherein said at least one induction coil has a helical shape.

29. An apparatus as claimed in claim 25, further comprising an electrically and/or thermally insulating layer to be located between said at least one induction coil and the refractory member.

30. An apparatus as claimed in claim 25, wherein said at least one induction coil is capable of being centered in the internal space.

31. An apparatus as claimed in claim 30, wherein said insulating member has a closed inner end.

32. An apparatus as claimed in claim 30, further comprising an insulating member for aligning said at least one induction coil centrally within the internal space.

33. An apparatus as claimed in claim 32, wherein said insulating member includes an outwardly extending flange to abut an end of the refractory member.

34. An apparatus as claimed in claim 32, wherein said insulating member is formed of an electrically and/or thermally insulating material.

35. An apparatus as claimed in claim 31, wherein said insulating member is a hollow member having an external configuration to fit in the internal space and an internal configuration to receive therein said at least one induction coil.

36. An apparatus as claimed in claim 35, wherein said insulating member has an open inner end.

37. An apparatus as claimed in claim 35, wherein said at least one induction coil is slidable into said insulating member.

38. An apparatus as claimed in claim 35, wherein said insulating member comprises a replaceable member.

39. An apparatus as claimed in claim 35, wherein said insulating member has a configuration to be positioned in the internal space as at least a partial lining of the refractory member.

40. An apparatus as claimed in claim 35, wherein said at least one induction coil and said insulating member are separable from each other after an inductive heating operation.

41. A method of inductively heating a refractory member having therein an internal space, said method comprising:

introducing into said internal space an inner inductor;

centering said inner inductor within said internal space by positioning an insulating member between said inner inductor and said refractory member within said internal space;

heating said refractory member by said inner inductor therein;

after said heating removing said inner inductor from said internal space; and thereafter decomposing said insulating member.

42. A method as claimed in claim 41, wherein said inner inductor comprises at least one induction coil.

43. A method as claimed in claim 42, wherein said heating comprises operating an induction generator connected to said at least one induction coil.

44. A method as claimed in claim 42, wherein said at least one induction coil has a helical shape.

45. A method as claimed in claim 42, wherein said insulating member is a hollow member having an external configuration fitting in said internal space and an internal configuration receiving therein said at least one induction coil.

46. A method as claimed in claim 42, wherein said insulating member has a closed inner end.

47. A method as claimed in claim 42, wherein said insulating member has an open inner end.

48. A method as claimed in claim 42, comprising sliding said at least one induction coil into said insulating member.

49. A method as claimed in claim 42, comprising positioning said insulating member within said internal space as at least a partial lining of said refractory member.

50. A method as claimed in claim 42, comprising abutting an outwardly extending flange of said insulating member with an end of said refractory member.

51. A method as claimed in claim 42, wherein said insulating member is formed of an electrically and/or thermally insulating material.

52. A method as claimed in claim 42, wherein said insulating member is formed of a highly heat resistant ceramic fiber material or ceramic foam material.

53. A method as claimed in claim 42, comprising heating an outwardly extending end flange of said refractory member with an outwardly extending winding of said at least one induction coil.

54. A method as claimed in claim 41, further comprising providing said refractory member with external insulation.

55. A method as claimed in claim 41, wherein said refractory member has over at least a portion of the exterior thereof an external metal shell.

56. A method as claimed in claim 41, wherein said internal space is tubular.

57. A method as claimed in claim 41, wherein said internal space is rectangular in transverse section.

58. A method as claimed in claim 41, wherein said refractory member comprises an immersible pouring tube.

59. A method as claimed in claim 41, wherein said refractory member comprises a molten metal discharge member.

60. A method of inductively heating a refractory member having therein an internal space, said method comprising:

introducing into said internal space an inner inductor;

centering said inner inductor within said internal space by positioning an insulating member between said inner inductor and said refractory member within said internal space;

abutting an outwardly extending flange of said insulating member with an end of said refractory member;

heating said refractory member by said inner inductor therein; and after said heating removing said inner inductor from said internal space.

61. A method as claimed in claim 60, wherein said inner inductor comprises at least one induction coil.

62. A method as claimed in claim 61, wherein said heating comprises operating an induction generator connected to said at least one induction coil.

63. A method as claimed in claim 61, wherein said at least one induction coil has a helical shape.

64. A method as claimed in claim 61, wherein said insulating member is a hollow member having an external configuration fitting in said internal space and an internal configuration receiving therein said at least one induction coil.

65. A method as claimed in claim 61, wherein said insulating member has a closed inner end.

66. A method as claimed in claim 61, wherein said insulating member has an open inner end.

67. A method as claimed in claim 61, comprising sliding said at least one induction coil into said insulating member.

68. A method as claimed in claim 61, wherein said insulating member comprises a replaceable member.

69. A method as claimed in claim 61, comprising positioning said insulating member within said internal space as at least a partial lining of said refractory member.

70. A method as claimed in claim 61, comprising separating said at least one induction coil and said insulating member from each other after said heating.

71. A method as claimed in claim 61, wherein said insulating member is formed of an electrically and/or thermally insulating material.

72. A method as claimed in claim 61, wherein said insulating member is formed of a highly heat resistant ceramic fiber material or ceramic foam material.

73. A method as claimed in claim 61, comprising heating an outwardly extending end flange of said refractory member with an outwardly extending winding of said at least one induction coil.

74. A method as claimed in claim 60, further comprising providing said refractory member with external insulation.

75. A method as claimed in claim 60, wherein said refractory member has over at least a portion of the exterior thereof an external metal shell.

76. A method as claimed in claim 60, wherein said internal space is tubular.

77. A method as claimed in claim 60, wherein said internal space is rectangular in transverse section.

78. A method as claimed in claim 60, wherein said refractory member comprises an immersible pouring tube.

79. A method as claimed in claim 60, wherein said refractory member comprises a molten metal discharge member.

80. A method of inductively heating a refractory member having therein an internal space, said method comprising:

introducing into said internal space an inner inductor in the form of at least one induction coil;

heating said refractory member by said at least one induction coil therein, including heating an outwardly extending end flange of said refractory member with an outwardly extending winding of said at least one induction coil; and after said heating removing said inner inductor from said internal space.

81. A method as claimed in claim 80, wherein said heating comprises operating an induction generator connected to said at least one induction coil.

82. A method as claimed in claim 80, comprising shaping and dimensioning said at least one induction coil to correspond to a shape and dimensions of said internal space.

83. A method as claimed in claim 80, wherein said at least one induction coil has a helical shape.

84. A method as claimed in claim 80, further comprising locating an electrically and/or thermally insulating layer between said at least one induction coil and said refractory member.

85. A method as claimed in claim 80, comprising centering said at least one induction coil within said internal space.

86. A method as claimed in claim 85, wherein said centering comprises positioning an insulating member between said at least one induction coil and said refractory member within said internal space.

87. A method as claimed in claim 86, wherein said insulating member is a hollow member having an external configuration fitting in said internal space and an internal configuration receiving therein said at least one induction coil.

88. A method as claimed in claim 87, wherein said insulating member has a closed inner end.

89. A method as claimed in claim 87, wherein said insulating member has an open inner end.

90. A method as claimed in claim 87, comprising sliding said at least one induction coil into said insulating member.

91. A method as claimed in claim 87, wherein said insulating member comprises a replaceable member.

92. A method as claimed in claim 87, comprising positioning said insulating member within said internal space as at least a partial lining of said refractory member.

93. A method as claimed in claim 87, comprising separating said at least one induction coil and said insulating member from each other after said heating.

94. A method as claimed in claim 86, wherein said insulating member is formed of an electrically and/or thermally insulating material.

95. A method as claimed in claim 86, wherein said insulating member is formed of a highly heat resistant ceramic fiber material or ceramic foam material.

96. A method as claimed in claim 80, further comprising providing said refractory member with external insulation.

97. A method as claimed in claim 80, wherein said refractory member has over at least a portion of the exterior thereof an external metal shell.

98. A method as claimed in claim 80, wherein said internal space is tubular.

99. A method as claimed in claim 80, wherein said internal space is rectangular in transverse section.

100. A method as claimed in claim 80, wherein said refractory member comprises an immersible pouring tube.

101. A method as claimed in claim 80, wherein said refractory member comprises a molten metal discharge member.

102. An apparatus for inductively heating a refractory member that is to be employed as part of a melt discharge device and that has therein an internal space through which is to pass the melt to be discharged, said apparatus comprising:

an inner inductor to be introduced selectively into the internal space, to achieve inductive heating of the refractory member from the internal space thereof, and to be withdrawn from the internal space after heating; and an insulator to be located between said inductor and the refractory member, said insulator having electrical and/or thermal insulating properties, said insulator comprising an insulating member having a configuration to be positioned in the internal space as at least a partial lining of the refractory member, said insulating member having a construction to be decomposed when coming into contact with the melt to be discharged.

103. An apparatus as claimed in claim 102, wherein said inductor has a configuration to be inserted into said insulator and to be withdrawn therefrom.

104. An apparatus as claimed in claim 102, wherein said insulating member is replaceably pushed onto said inductor, such that said inductor and said insulating member are insertable together into the internal space and are withdrawable together therefrom.

105. An apparatus as claimed in claim 102, wherein said inductor comprises at least one induction coil.

106. An apparatus as claimed in claim 105, further comprising an induction generator connected to said at least one induction coil.

107. An apparatus as claimed in claim 105, wherein said at least one induction coil has a shape and dimensions to correspond to the shape and dimensions of the internal space.

108. An apparatus as claimed in claim 105, wherein said at least one induction coil has a helical shape.

109. An apparatus as claimed in claim 105, wherein said at least one induction coil has a configuration to enable adjustment of spacings thereof from different regions of the refractory member to enable adjustment of amounts of energy transferred thereto.

110. An apparatus as claimed in claim 105, wherein said at least one induction coil is capable of being centered in the internal space.

111. An apparatus as claimed in claim 105, wherein said insulator aligns said at least one induction coil centrally within the internal space.

112. An apparatus as claimed in claim 105, wherein said insulator has a closed inner end.

113. An apparatus as claimed in claim 105, wherein said insulator has an open inner end.

114. An apparatus as claimed in claim 105, wherein said at least one induction coil includes an outwardly extending winding to heat an outwardly extending end flange of the refractory member.

115. An apparatus as claimed in claim 102, wherein said insulator includes an outwardly extending flange to abut an end of the refractory member.

116. An apparatus as claimed in claim 102, wherein said insulator is formed of a highly heat resistant ceramic fiber material or ceramic foam material.

117. A method for inductively heating a refractory member that is part of a melt discharge device and that has therein an internal space through which the melt is to be discharged, said method comprising:

introducing an inner inductor into said internal space;

providing an insulator having electrical and/or thermal insulating properties in said internal space between said inductor and said refractory member;

inductively heating said refractory member from said internal space by said inductor; and after said heating removing said inductor from said internal space.

118. A method as claimed in claim 117, comprising providing said insulator as an insulating layer on said refractory member.

119. A method as claimed in claim 117, comprising providing said insulator as an insulating member positioned in said internal space as at least a partial lining of said refractory member.

120. A method as claimed in claim 119, further comprising, after removal of said inductor from said internal space, discharging said melt through said internal space in contact with said insulating member and thereby decomposing said insulating member.

121. A method as claimed in claim 117, comprising providing said insulator as an insulating member, and replaceably pushing said insulating member onto said inductor, and wherein said inductor and said insulating member are inserted together into said internal space prior to said heating and are withdrawn together from said internal space after said heating.

122. A method as claimed in claim 117, wherein said inductor comprises at least one induction coil.

123. A method as claimed in claim 122 wherein said heating comprises operating an induction generator connected to at least one induction coil.

124. A method as claimed in claim 122, comprising shaping and dimensioning said at least one induction coil to correspond to a shape and dimensions of said internal space.

125. A method as claimed in claim 122, wherein said at least one induction coil has a helical shape.

126. A method as claimed in claim 122, further comprising adjusting spacings of said at least one induction coil from different regions of said refractory member to thereby adjust amounts of energy transferred thereto.

127. A method as claimed in claim 122, comprising centering said at least one induction coil within said internal space.

128. A method as claimed in claim 122, wherein said insulator is a hollow member having an external configuration fitting in said internal space and an internal configuration receiving therein said at least one induction coil.

129. A method as claimed in claim 122, wherein said insulator has a closed inner end.

130. A method as claimed in claim 122, wherein said insulator has an open inner end.

131. A method as claimed in claim 122, comprising heating an outwardly extending end flange of said refractory member with an outwardly extending winding of said inductor coil.

132. A method as claimed in claim 117, comprising abutting an outwardly extending flange of said insulator with an end of said refractory member.

133. A method as claimed in claim 117, wherein said insulator is formed of a highly heat resistant ceramic fiber material or ceramic foam material.

134. A method as claimed in claim 117, further comprising providing said refractory member with external insulation.

135. A method as claimed in claim 117, wherein said refractory member has over at least a portion of the exterior thereof an external metal shell.

136. A method as claimed in claim 117, wherein said internal space is tubular.

137. A method as claimed in claim 117, wherein said internal space is rectangular in transverse section.

138. A method as claimed in claim 117, wherein said refractory member comprises an immersible pouring tube.

* * * * *